US005136835A

United States Patent [19]

Hirao

[11] Patent Number: 5,136,835

[45] Date of Patent: Aug. 11, 1992

[54] FALSE TWISTING METHOD FOR YARNS AND FALSE TWISTING APPARATUS THEREFOR

[75] Inventor: Osamu Hirao, Uji, Japan

[73] Assignee: Murata Kikai Kabushiki Kaisha, Kyoto, Japan

[21] Appl. No.: 759,948

[22] Filed: Sep. 17, 1991

Related U.S. Application Data

[63] Continuation of Ser. No. 478,697, Feb. 12, 1990, abandoned.

[30] Foreign Application Priority Data

Feb. 13, 1989 [JP] Japan ..... 1-34567

[51] Int. Cl.[5] ..... D01H 7/92; D02G 1/02; D02G 1/08

[52] U.S. Cl. ..... 57/285; 57/284; 57/334

[58] Field of Search ..... 57/284, 332, 348, 334, 57/336, 352, 285

[56] References Cited

U.S. PATENT DOCUMENTS

| | | | |
|---|---|---|---|
| 2,463,619 | 3/1949 | Kunzle | 57/332 |
| 3,327,461 | 6/1967 | Wyatt | 57/284 |
| 3,635,008 | 1/1972 | Guy | 57/348 X |
| 3,667,209 | 6/1972 | Fain | 57/285 X |
| 3,696,601 | 10/1972 | McCard | 57/285 |
| 3,791,130 | 2/1974 | Inuyama et al. | 57/285 |
| 4,195,468 | 4/1980 | King et al. | 57/352 X |
| 4,296,598 | 10/1981 | Faure | 57/284 |
| 4,478,037 | 10/1984 | Backer | 57/334 X |
| 4,956,970 | 9/1990 | Bauer et al. | 57/348 X |

*Primary Examiner*—Daniel P. Stodola
*Assistant Examiner*—William Stryjewski
*Attorney, Agent, or Firm*—Spensley Horn Jubas & Lubitz

[57] ABSTRACT

A false twisting method and device for twisting a yarn which runs under a predetermined tension includes an arrangement wherein the yarn is wound about a member such as a cylindrical member positioned approximately at the halfway point of the running of the yarn, and a yarn downstream of the wound member and a yarn upstream of the wound member intersect each other in a contacted state to provide a twist in the yarn.

18 Claims, 11 Drawing Sheets

FALSE TWISTING METHOD FOR YARNS AND FALSE TWISTING APPARATUS THEREFOR

This is a continuation of application Ser. No. 07/478,697, filed on Feb. 12, 1990, now abandoned.

FIELD OF THE INVENTION

The present invention relates to a false twisting method and apparatus for yarns employed in a yarn texturing process which continuously performs twisting - thermofixing - untwisting.

RELATED ART STATEMENT

As a yarn twisting method of this kind, there is known a method for bringing yarn into direct contact with a rotary member and utilizing a frictional force to twist the yarn. One example is shown in FIGS. 10*a* and 10*b*.

In the FIG. 10 example, as rotary members, a number of rotary disks a are used. That is, three rotational shafts b having more than two rotary disks a secured thereto are equidistantly arranged, and a yarn c is threaded into the center thereof to provide a twist corresponding to the ratio between the diameter of the yarn c and the diameter of the rotary disk a. This method is suited for the high speed process for filament yarns whose number of twists is thousand of twist per meter.

The yarn twisting method mentioned above uses the rotary disks a to thereby render possible the high speed process, but has problems in that the construction is complicated and the threading operation becomes difficult.

OBJECT AND SUMMARY OF THE INVENTION

The present invention has been achieved in view of the problems noted above, and it is an object of the present invention to provide a novel false twisting method for yarns and a false twisting apparatus therefor which is simple in construction and can perform high speed process.

For achieving the aforesaid object, a false twisting method for yarns for twisting a yarn which runs under a predetermined tension according to an embodiment of the present invention comprises an arrangement wherein the yarn is wound about a member to be wound such as a cylindrical member positioned approximately at the halfway point of the running of the yarn, and a yarn downstream of a member to be wound and a yarn upstream of a member to be wound intersect each other in a contacted state to provide a twist in the yarn. Alternatively, there can be provided a method in which the member to be wound comprises a rotary member whose rotational shaft is obliquely arranged with respect to the running direction of the yarn.

As a false twisting apparatus suitable for the above-described false twisting method, there is a false twisting apparatus for yarns for imparting a twist to a yarn which runs under a predetermined tension, wherein the apparatus comprises a rotary member whose rotational shaft is obliquely arranged with respect to the running direction, and a pair of upstream and downstream guide members arranged around the rotary member to define the running direction of the yarn, the downstream guide member being positioned in the range of 135° to 315° in a winding direction of the yarn to the rotary member with respect to the upstream guide member.

Preferably, the rotational shaft of the rotary member is swingable in the running direction of the yarn or the guide member is movable in the direction of the rotational shaft.

Preferably, the rotational shaft of the rotary member is driven.

DETAILED DESCRIPTION OF PREFERRED EMBODIMENT

As the member to be wound such as a cylindrical member positioned at approximately the halfway point of the running of the yarn, the rotary member whose rotational shaft is obliquely arranged will be described. The yarn downstream of the rotary member and the yarn upstream of the rotary member intersect in a contacted state, and therefore, the yarn is defined in position and rolled onto the rotary member to provide a twist therein. The important function of the present invention is that as shown in FIG. 1*c*, the upstream yarn wound around the rotary member causes the downstream yarn to be rolled due to the friction between the yarns to provide a twist therein. The number of twists are rapidly increased by the synergetic addition of these twists.

Figure 1A:
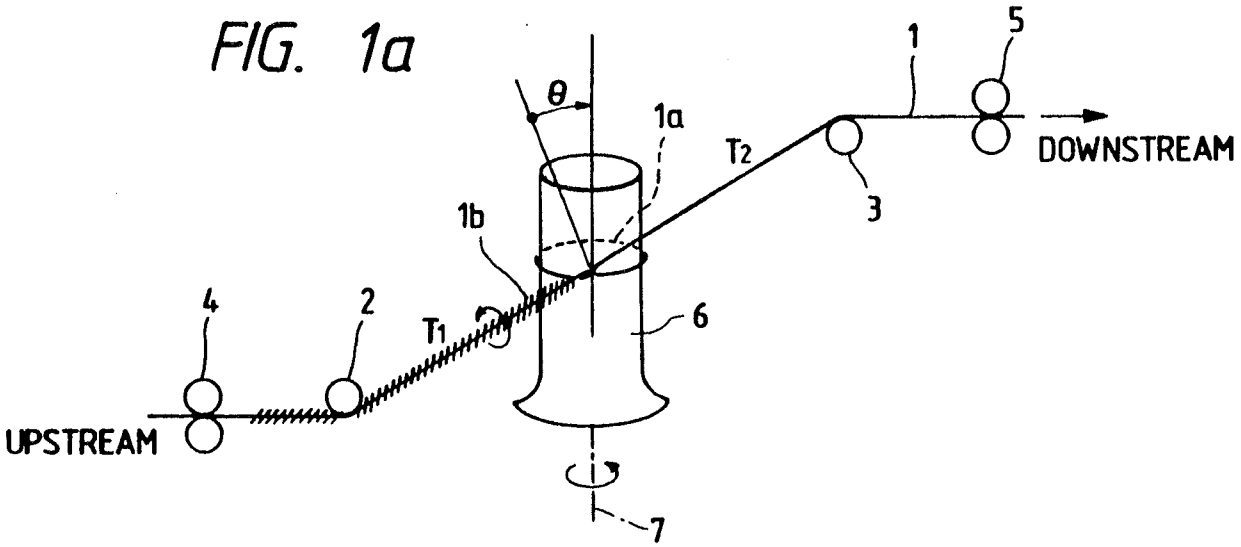
FIGS. 1*a* to 1*d* are views showing an embodiment of the false twisting method.
Figure 1C:
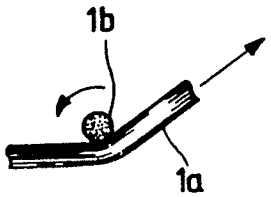
Figure 1D:
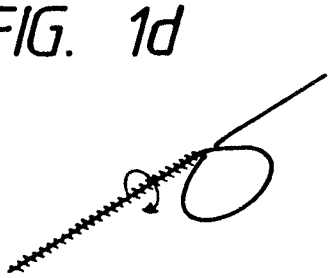

As shown in FIGS. 1*a* or 1*d*, when the winding direction is changed to provide an intersection between the yarn downstream of the rotary member and the yarn upstream of the rotary member in a contacted state, the direction in which the yarn rolls on the rotary member as well as the direction of the twist due to the friction between the yarns are changed to provide S-twist or Z-twist.

The twisting apparatus for positioning the downstream guide member in the range of 135° to 315° in a winding direction of yarn to the rotary member with respect to the upstream guide member properly corrects the intersection in the contacted state of the yarns. That is, in case of 135° (315° at the winding angle of the yarn) or less, the yarns intersect each other at a position away from the rotary member, failing to maintain the contact state in which a twist is provided. When exceeding 315° (495° at the winding angle of yarn), the yarns contact each other lengthwise parallel, making it difficult to provide a twist. Preferably, the guide member is arranged in the range of 180° to 270°.

When the rotational shaft of the rotary member is made swingable in the running direction of the yarn or the guide member is made movable in the direction of the rotational shaft, the angle of inclination between the yarn and the rotary member varies and the twist varies. That is, when the angle of inclination increases, the twist increases, whereas when the angle of inclination decreases, the twist decreases.

When the rotational shaft of the rotary member is driven, a difference between tension $T_1$ of the yarn upstream and tension $T_2$ of the yarn downstream reduces, and particularly, the reduction in twist between the yarns caused by the reduction in tension $T_1$ of the yarn at upstream is restrained.

An embodiment of the present invention will be described with reference to the drawings.

Figure 1B:
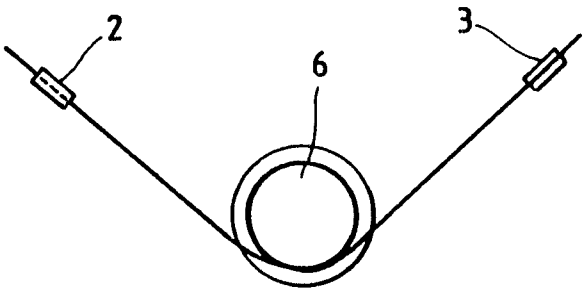

FIGS. 1*a* to 1*d* are views showing a false twisting method. In FIG. 1*a*, a yarn 1 runs under a predetermined tension by feed rollers 4 and 5 while being defined in position by a guide member 2 upstream and a guide member 3 downstream. A rotational shaft 7 of a rotary cylinder 6 as a member to be wound is arranged obliquely with respect to the running direction of the yarn, and the yarn 1 is wound about the rotary cylinder 6 at an angle of inclination $\theta$. A yarn 1*a* downstream wound about the rotary cylinder 6 counterclockwise passes under a yarn 1*b* upstream, and the yarn 1*b* at upstream intersects with the yarn 1*a* at downstream in a contacted state. When the yarn 1 runs, the yarn on the rotary cylinder 6 tends to be fed downwardly. However, since the yarn is held in position by the guide members 2 and 3, the yarn rolls on the rotary cylinder 6 to provide a twist therein. As shown in FIG. 1*c*, the yarn 1*b* at upstream further rolls on the yarn 1*a* downstream due to friction to provide a twist in the same direction as the twist on the rotary cylinder 6. The twist of the yarns due to friction and the twist on the rotary cylinder are synergetically added. In this manner, the yarn 1*b* upstream assumes a twisting state of the S-twist. Next, as shown in FIG. 1*d*, when the winding direction of the yarn with respect to the rotary cylinder 6 is made to be clockwise, both the direction of the twist of the yarns due to friction and the direction of the twist on the rotary cylinder are reversed to provide a Z-twist. Switching between the S-twist and Z-twist may be made merely by changing the winding direction (when the rotary member is driven, the driving direction is also reversed). As shown in FIG. 1*b*, the guide members 2 and 3 are not always linearly arranged but it is necessary that the yarns are superposed to each other to some extent as shown, which will be described hereinafter.

Next, the twisting apparatus suitable for the aforementioned false twisting method will be described with reference to FIGS. 2 to 8.

Figure 2C:
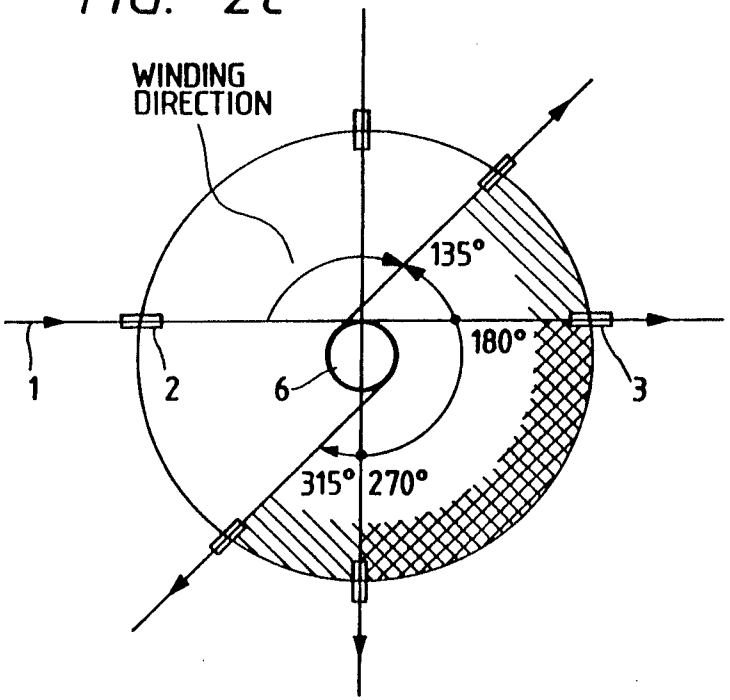
FIGS. 2*a* to 2*c* are views showing an appropriate arrangement of a guide member.
Figure 2A:
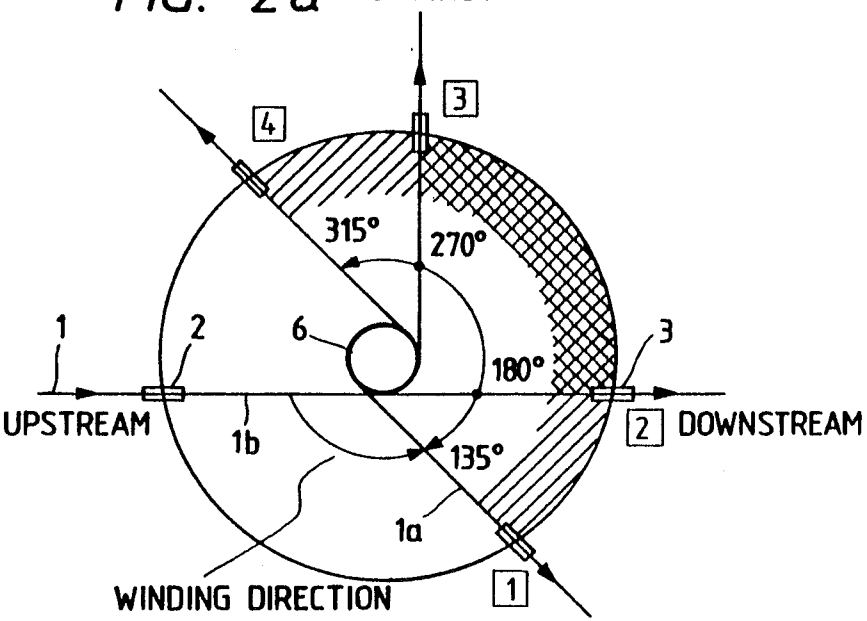
Figure 2B:
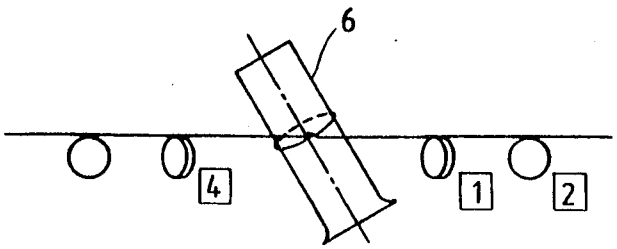

FIGS. 2*a* to 2*c* are views showing appropriate arrangement of guide members 2 and 3.

FIGS. 2*a* and 2*b* show an arrangement of guide members 2 and 3 in a case where a yarn 1 is wound counterclockwise on the rotary cylinder 6 to provide an S-twist. When the rotary cylinder 6 is set at the center position with the guide member 2 upstream to be a reference, the guide member 3 downstream is arranged at a position of 135° to 315°, preferably 180° to 270° in a winding direction. Too much or too little intersection between the yarn 1*b* upstream and the yarn 1*a* at downstream in a contacted state makes it difficult to provide a twist. In the case of less than 135°, the yarns are intersected in the space, and the contact pressure between the yarns reduces, as a consequence of which the number of twists are extremely decreased. In the range of 135° to 180° (1 to 2), the yarn 1*b* upstream and the yarn 1*a* downstream are geometrically intersected at a position away from the outer periphery of the rotary cylinder 6. However, this extent is minor and substantially makes little difference from the intersection on the rotary cylinder 6. In the range of 180° to 270° (1 to 2), they are completely intersected on the rotary cylinder 6. As the angle increases, the distance of intersection extends. When the distance of intersection extends, the probability of rolling of the yarn 1*b* upstream due to the friction with the yarn 1*a* at downstream increases, whilst the contact pressure reduces to become slippery. The optimum value is within the range of 180° to 270° in dependence of coarseness of yarn and angle of inclination. The range of 270° to 315° (3 to 4) is disadvantageous in which the contact pressure reduces, but that extent is minor and is not practically inconvenient. When in excess of 315°, the yarns nearly become parallel with each other and merely rub each other, and the number of twists extremely reduce. FIG. 2*c* shows an arrangement of guide members 2 and 3 in a case where the yarn 1 is wound clockwise about the rotary cylinder 6 to provide a Z-twist. This is similar to FIG. 2*a* except that the winding direction is changed and the calculating direction of angle is changed.

The guide members 2 and 3 are used in combination with ceramic bars, rotational rolls or feed rolls.

The appropriate inclination of the rotary cylinder 6 with respect to the yarn 1 will be described hereinafter with reference to FIGS. 3 to 6.

Figure 3:
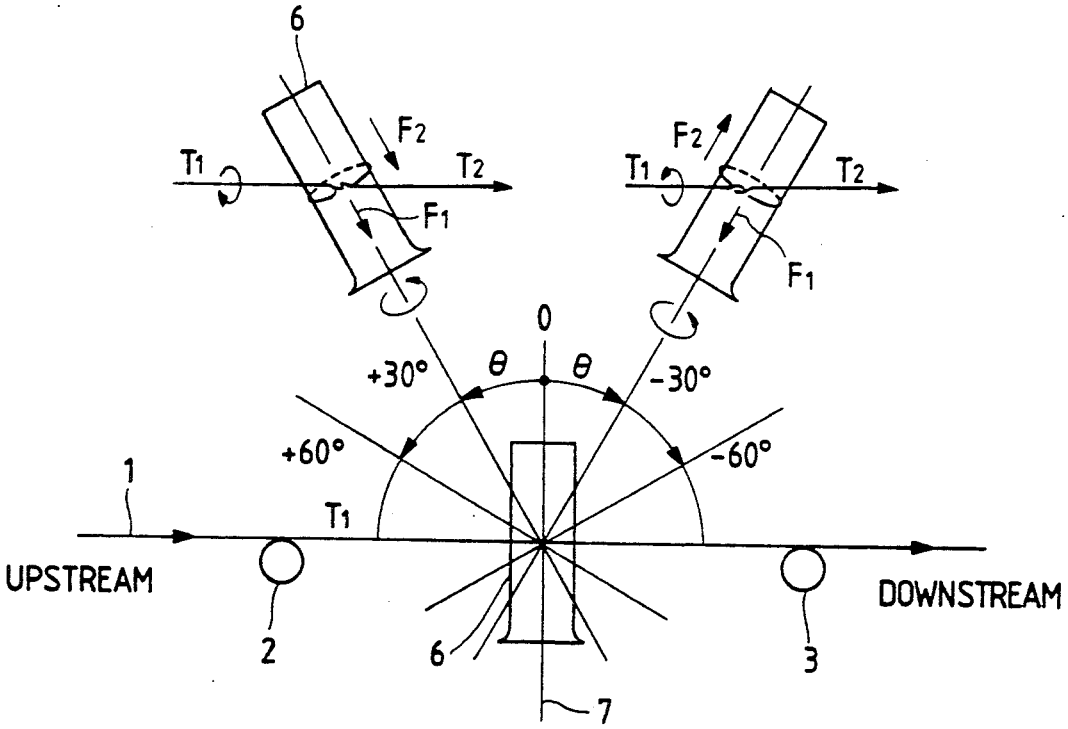
FIG. 3 is a view showing an appropriate inclination of a rotary cylinder.
Figure 4:
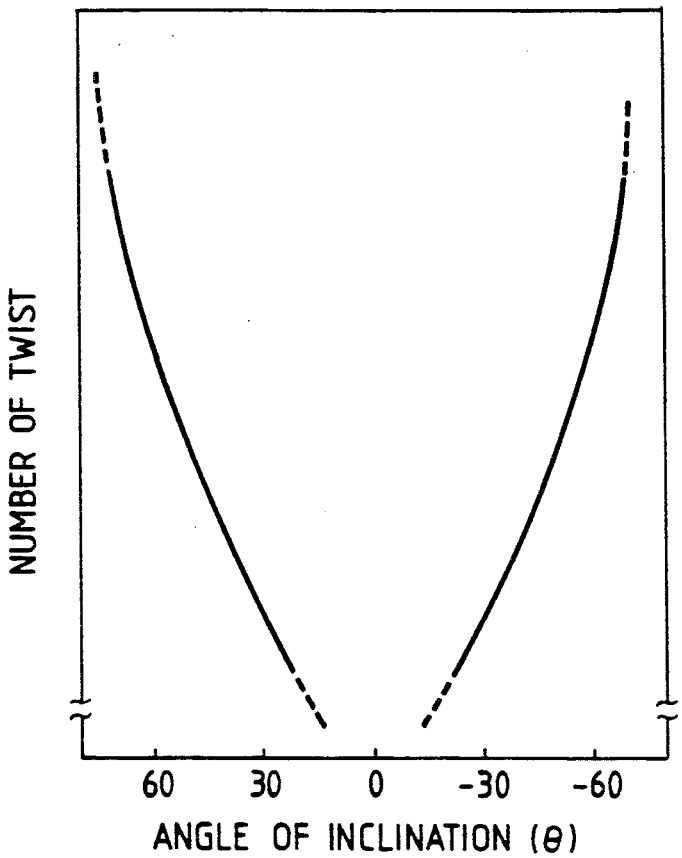
FIG. 4 is a graphic representation showing the relationship between the inclination of the rotary cylinder and the number of twists.
Figure 5:
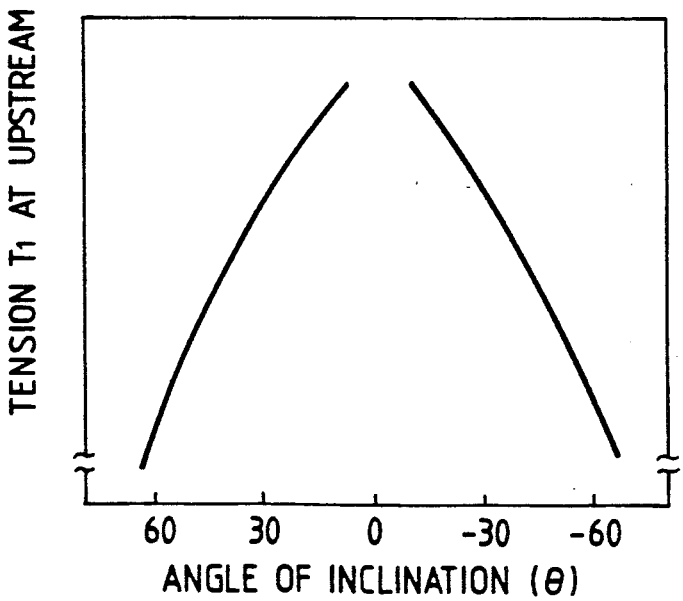
FIG. 5 is a graphic representation showing the relationship between the inclination of the rotary cylinder and the tension at upstream.

In FIG. 3, the yarn 1 is at right angle to the rotational shaft 7 of the rotary cylinder 6 and an angle at which twist is not theoretically provided is zero. As shown in FIGS. 4 and 5, as the angle $\theta$ increases (in plus direction and in minus direction), the number of twists increases whereas the tension $T_1$ upstream decreases, the yarn forming an "X" at the intersecting point of the upstream and downstream yarn portions on the circumferential surface of the rotary cylinder 6, as shown in FIGS. 2*b* and 3 (in case where the rotary cylinder 6 is in free rotation). However, the twist is stabilized in the inclination on the plus side than the inclination on the minus side. That is, in FIG. 3, in the inclination on the plus side, force $F_1$ due to friction between the yarns and force $F_2$ due to the rolling on the rotary cylinder 6 are in the same direction whereas in the inclination on the minus side, $F_1$ and $F_2$ are reversed from each other.

Accordingly, in the inclination on the minus side, the yarn is likely to pulsate on the rotary cylinder 6 due to the variation in difference between $F_1$ and $F_2$. When the angle $\theta$ is close to 0° or close to 90°, there occurs an unstable area which is not practical. Accordingly, preferably, the angle $\theta$ is varied between 20° and 70° to thereby render possible adjustment of the stable number of twists.

Figure 6:
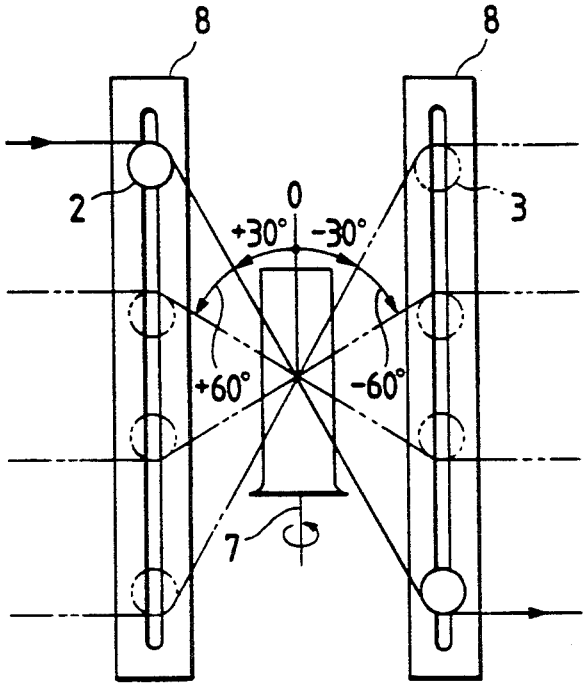
FIG. 6 is a view showing another embodiment of the guide member.

While in FIG. 3, a description has been made in which the angle $\theta$ is made variable by the swinging of the rotational shaft 7, it is to be noted that as shown in FIG. 6, the rotational shaft 7 is fixed, and the guide member 2 upstream and the guide member 3 downstream are made relatively movable by the guide rail 8 to thereby render the angle variable.

Figure 7A:
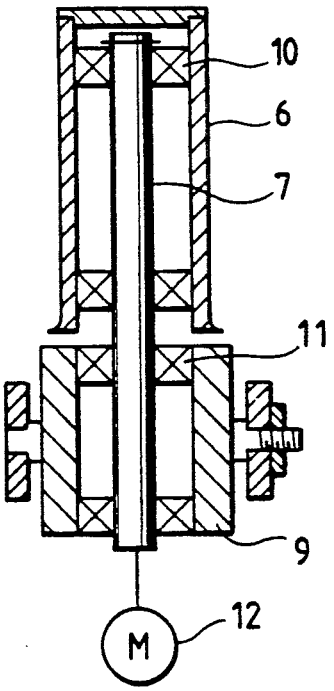
FIGS. 7*a* and 7*b* are sectional views showing a driving mechanism of the rotary cylinder.
Figure 7B:
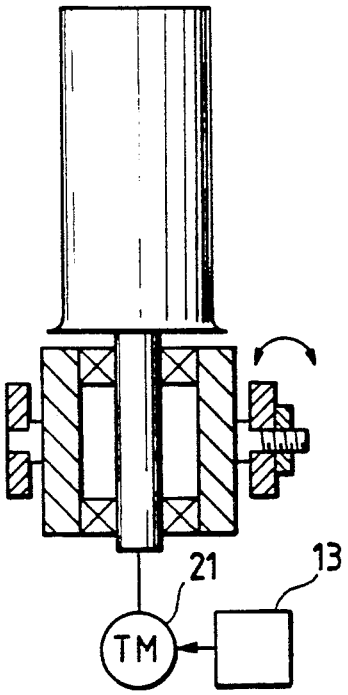

Next, the optimum rotating mechanism for the rotary cylinder 6 will be described with reference to FIG. 7. It is desirable for the rotary cylinder 6 to be rotated at low friction. Accordingly, as shown in FIG. 7*a*, bearings 10 and 11 are provided within the rotary cylinder 6 and a housing 9 to rotate the rotary cylinder 6 at low friction. The rotational shaft 7 is driven at an rpm corresponding to the rotary cylinder 6 whereby the frictional force of the bearing 10 can be made substantially zero. When the rotational shaft 7 is driven at a value in excess of the rpm of the rotary cylinder 6, it is driven at a slight torque corresponding to the frictional force of the bearing 10. FIG. 7*b* shows the case where a torque motor 21 is controlled by a controller 13. When it is rotated at a speed slightly higher than the speed of yarn, the reduction in tension $T_1$ upstream shown in FIG. 5 can be decreased to increase the number of twists. It is to be noted that the rotary cylinder 6 may comprise a non-rotational fixed member which is totally reversed to the aforementioned form.

Figure 8A:
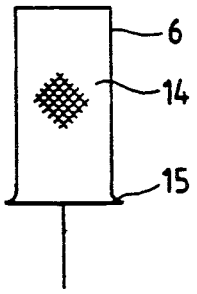
FIGS. 8*a* to 8*d* are views showing the rotary cylinder.
Figure 8B:
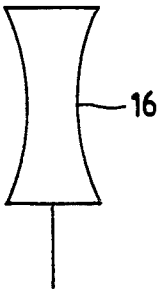
Figure 8C:
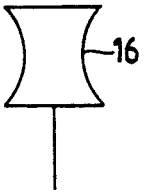
Figure 8D:
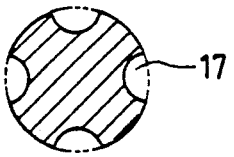

The surface and shape of the rotary cylinder will be described hereinafter with reference to FIGS. 8*a* to 8*d*. Preferably, the surface of the rotary cylinder 6 is less slippery because the yarn may roll thereon to provide a twist. Accordingly, pear plating 14 rather than mirror finish increases the number of twists. For example, if rubber lining is employed, slip is eliminated whereby the yarn can roll completely. As for the shape of the rotary cylinder, a circular cylinder or a column is used as shown in FIG. 8*a*, one end of which is provided with a collar 15 to prevent a yarn from being slipped out. Alternatively, a hand drum type may be employed as shown in FIG. 8*b*. In the hand drum type, the yarn tends to be stabilized at the minimum diameter portion 16, which is therefore used in case of the minus inclination of FIG. 3. In case of providing a specially processed yarn in which twist is periodically varied instead of a case of providing a fixed twist, a rotary member with a notch 17 provided in section may be used as shown in FIG. 8*d*.

Figure 10A:
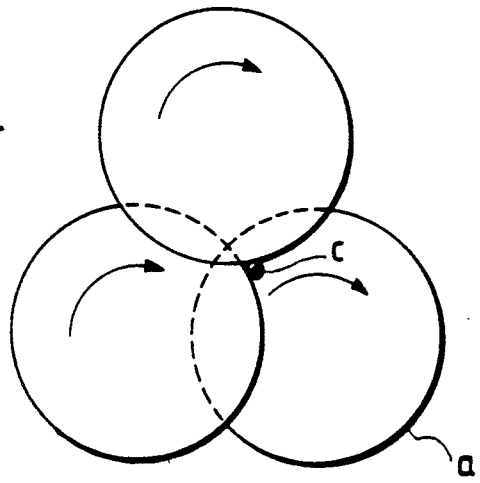
FIG. 10a PRIOR ART
FIGS. 10*a* and 10*b* are views showing a conventional false twisting method.
Figure 10B:
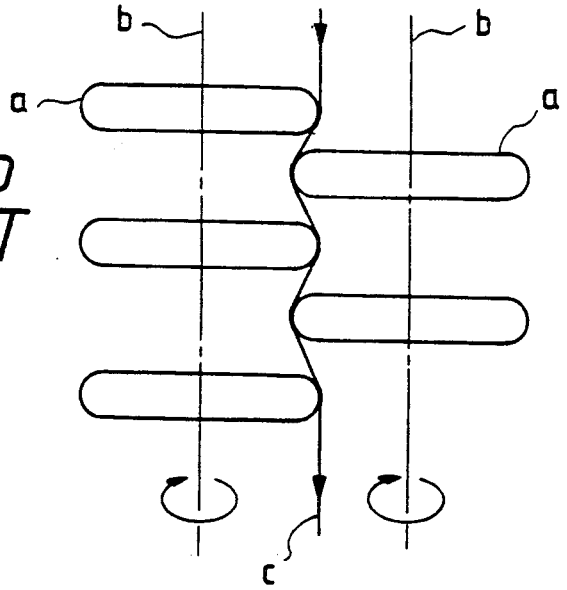
FIG. 10b PRIOR ART

According to the yarn false twisting method and false twisting apparatus as described above, even a free rotary member, if the optimum condition is combined therewith, it is possible to obtain the number of twists that may be compared favorably with one shown in FIG. 10.

The structure of machine in which the present false twisting apparatus is applied to a conventional false twisting machine will be described with reference to FIG. 9.

Figure 9:
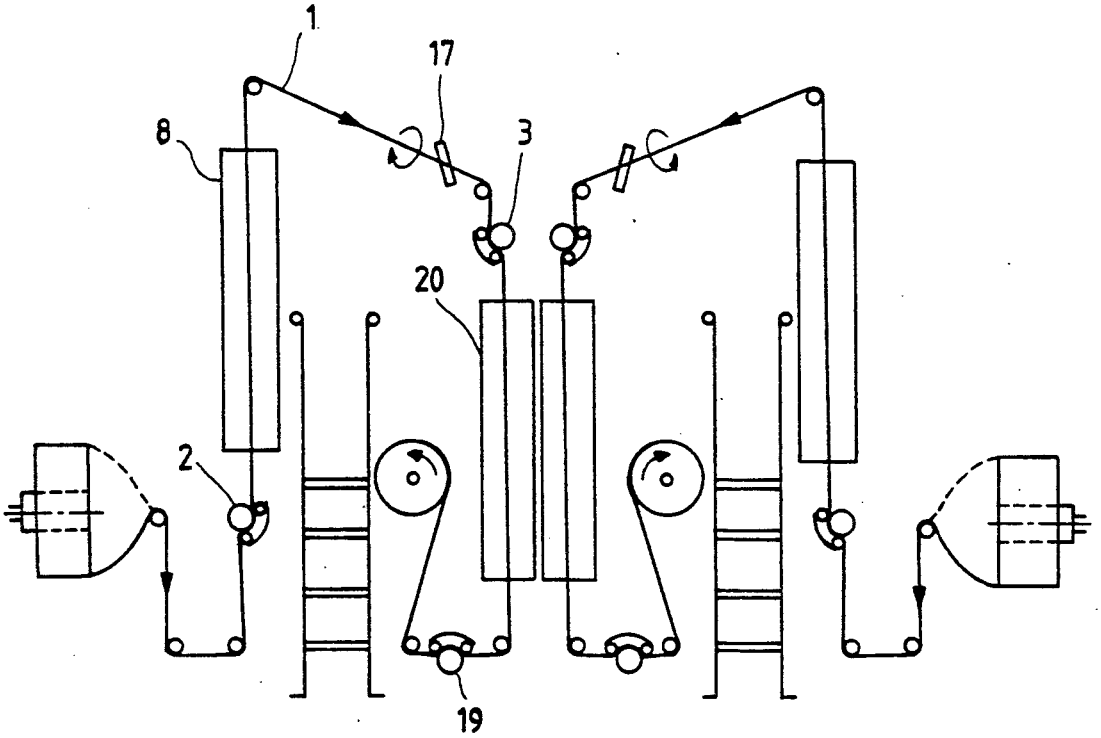
FIG. 9 is a view showing an example applied to a false twisting machine.

In FIG. 9, a yarn 1 is held under a predetermined yarn tension for drawing by a feed roller 2 upstream and a feed roller 3 downstream. A false twisting apparatus 17 according to the present invention is provided downstream between the two feed rollers 2 and 3. The yarn 1 up to the feed roller 2 is twisted by the false twisting apparatus 17. A thermofixing heater 8 is provided upstream between the two feed rollers 2 and 3. Since this heater 8 heats the twisted yarn 1 to a drawing temperature, a hot plate or the like is employed which performs heating while bringing the yarn into contact with a hot plate which is controlled in temperature with accuracy by dowtherm vapor or the like. A third feed roller 19 is further provided at the rear of the feed roller 3 downstream, and a secondary heater 20 is provided between these two feed rollers 3 and 19. The secondary heater 20 is provided to subject the yarn after bulk process to reheat treatment to reduce the expandability and merely leave the bulkness. However, the secondary heater 20 is not necessarily provided but may be operated according to the kind of yarn 1. The false twisting apparatus 17 according to the present invention is simple in construction and easy in operation, and is an epochal false twisting apparatus which involves less abrasive parts, as opposed to one using a twister belt and renders possible stabilized operation.

The false twisting method and false twisting apparatus according to the present invention are not limited to the substitution of the false twisting apparatus of the aforementioned false twisting machine but can be applied to the cases where this false twisting apparatus is arranged before or behind of a conventional nip type belt twister to effect auxiliary twisting, where the nip type belt twister is turned ON-OFF to produce a specially processed yarn and where a high torque yarn is produced independently.

Since the present invention is constituted as mentioned above, it has the following effects.

A yarn is wound about the outer periphery of a member to be wound arranged obliquely with respect to the running direction of the yarn, a yarn downstream and a yarn upstream are intersected in a contacted state, and a twist is provided in the yarn by the rolling of the yarns and the friction between the yarns. Therefore, it is possible to obtain a number of twists by the simple structure of machine.

Furthermore, the winding direction of the yarn with respect to the rotary member as a member to be wound is changed whereby the S-twist and Z-twist can be simply switched.

Moreover, the false twisting apparatus wherein the guide member downstream is positioned in the range of 135° to 315° in the winding direction of the yarn to the rotary member with respect to the guide member upstream can stably provide a twist caused by the intersection of yarns.

In addition, if the rotational shaft of the rotary member is made swingable in the running direction of the yarn or the guide member is made movable in the direction of the rotational shaft, the number of twists can be simply adjusted.

Moreover, when the rotational shaft of the rotary member is driven, the reduction in yarn tension upstream can be decreased and the number of twists can be increased.

Experimental results obtained by using the false twisting apparatus of the present invention will be described hereinafter.

EXPERIMENTAL EXAMPLE 1

Figure 11:
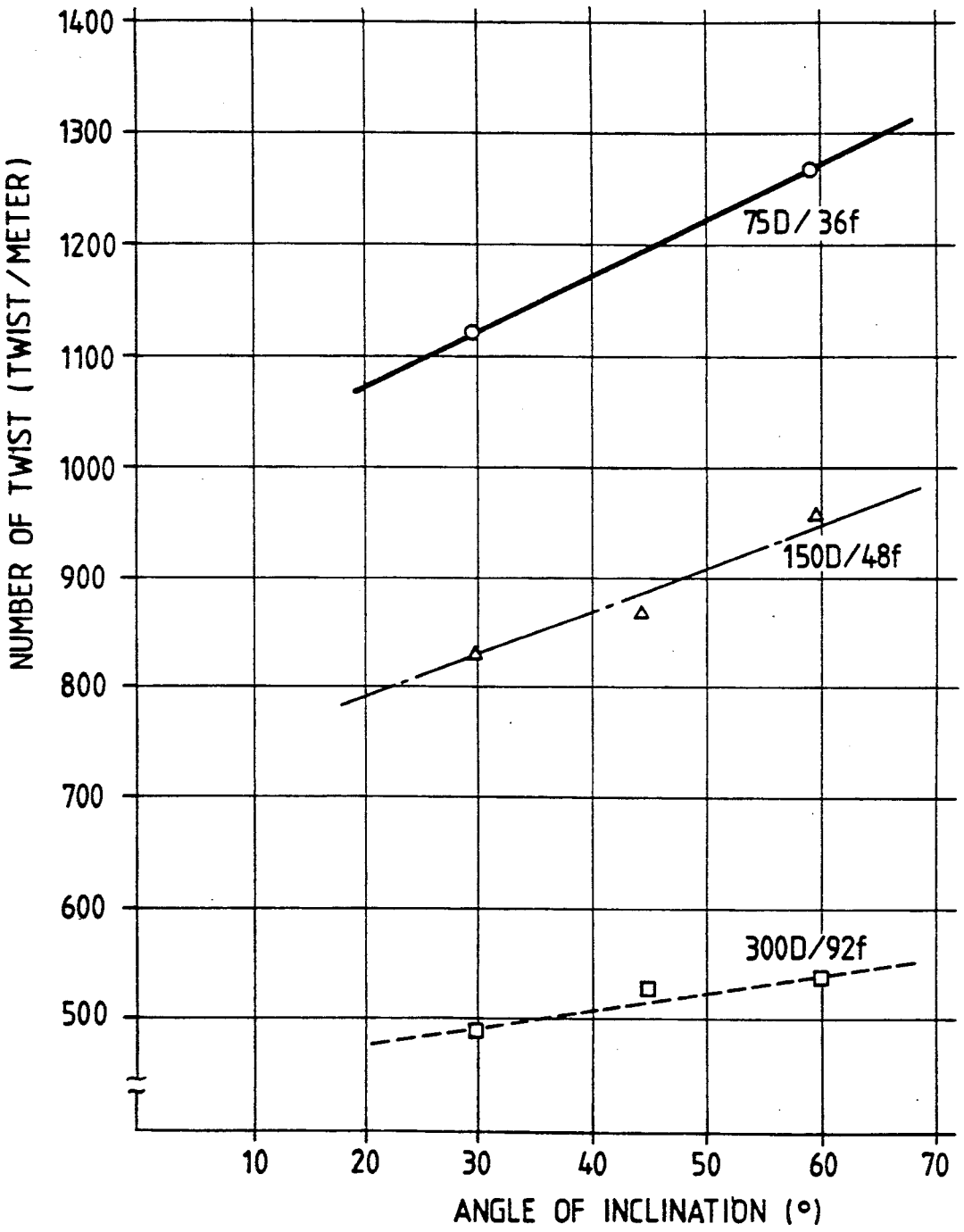
FIG. 11 is a graphic representation showing the relationship between the inclination of the rotary cylinder and the number of twists.

With respect to the relationship between an angle of inclination and the number of twists in FIG. 4, the result of experiment in connection with yarns having different yarn thickness, which is changed to the plus side, is graphically shown in FIG. 11. 75D/36f means yarns of 75 denier with 36 filament yarns as a fibrous bundle.

EXPERIMENTAL EXAMPLE 2

Figure 12:
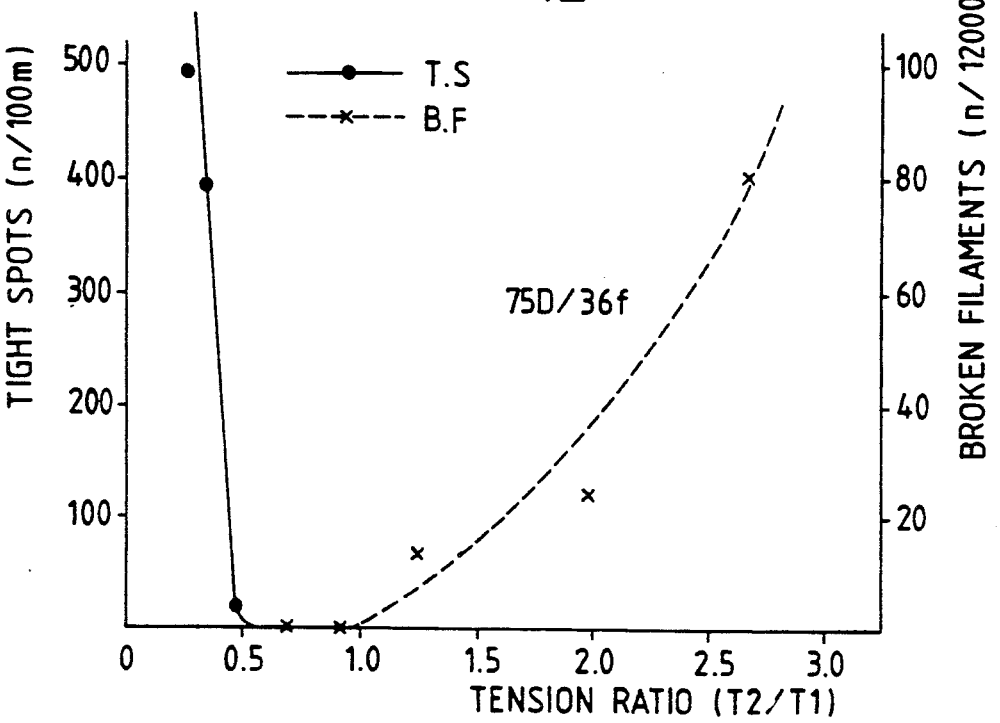
FIG. 12 is a graphic representation showing the relationship between the number of tight spots and the number of broken filaments when the tension ratio is varied.
Figure 13:
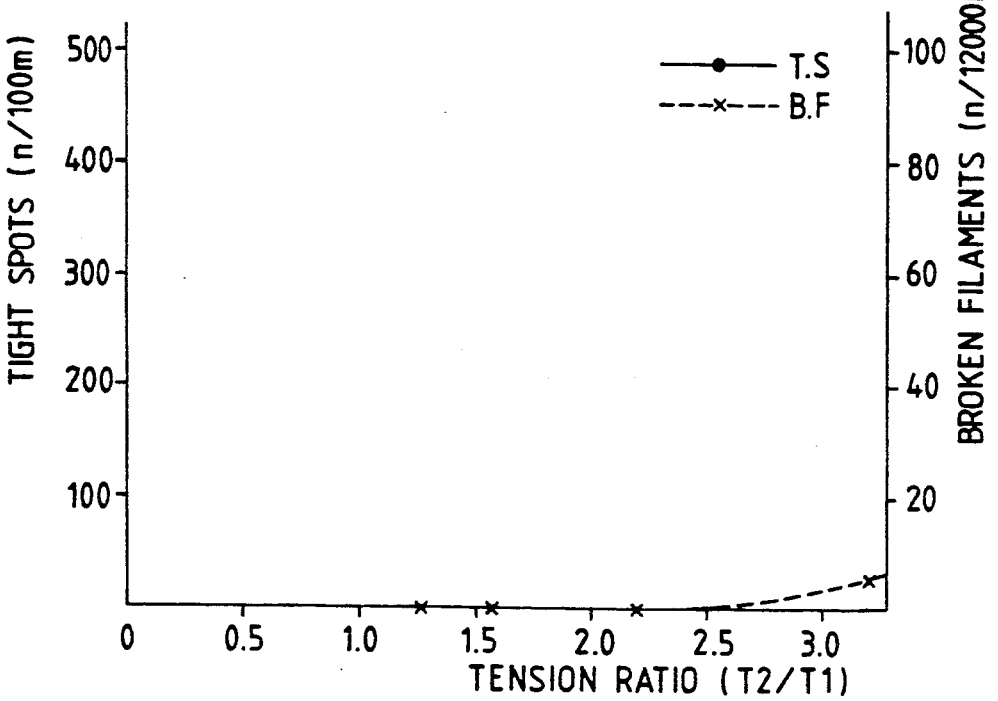
FIG. 13 is another graphic representation showing the same relationship as that shown in FIG. 12.
Figure 16:
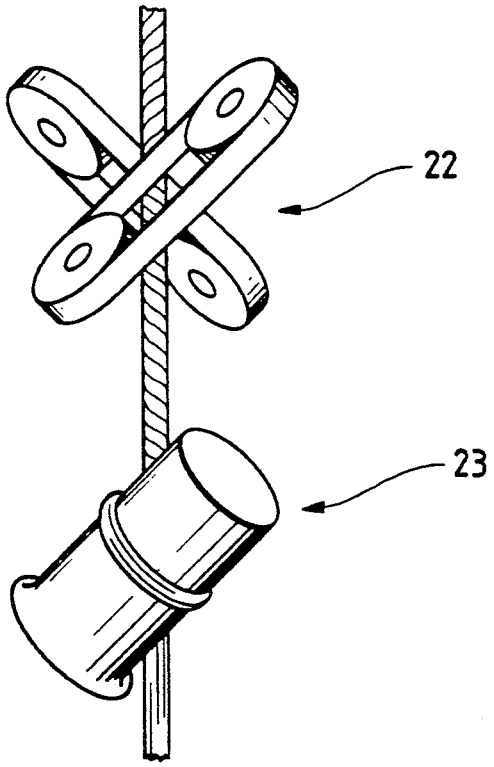
FIG. 16 is a schematic illustration showing a false twisting apparatus using a nip belt and a rotary cylinder.

With respect to the number of tight spots (not untwisted portion) and number of cut filaments (number of fluffs) when the tension ratio is varied, the result of (i) the case where twisting process is made merely by the nip belt and 22 of FIG. 16 is shown in FIG. 12 the result of (ii) the case where process is made by providing a winding member 23 of FIG. 16 at downstream of the nip belt 22 of FIG. 16 is shown in FIG. 13. The (ii) case is larger in area capable of being processed.

EXPERIMENTAL EXAMPLE 3

Figure 14:
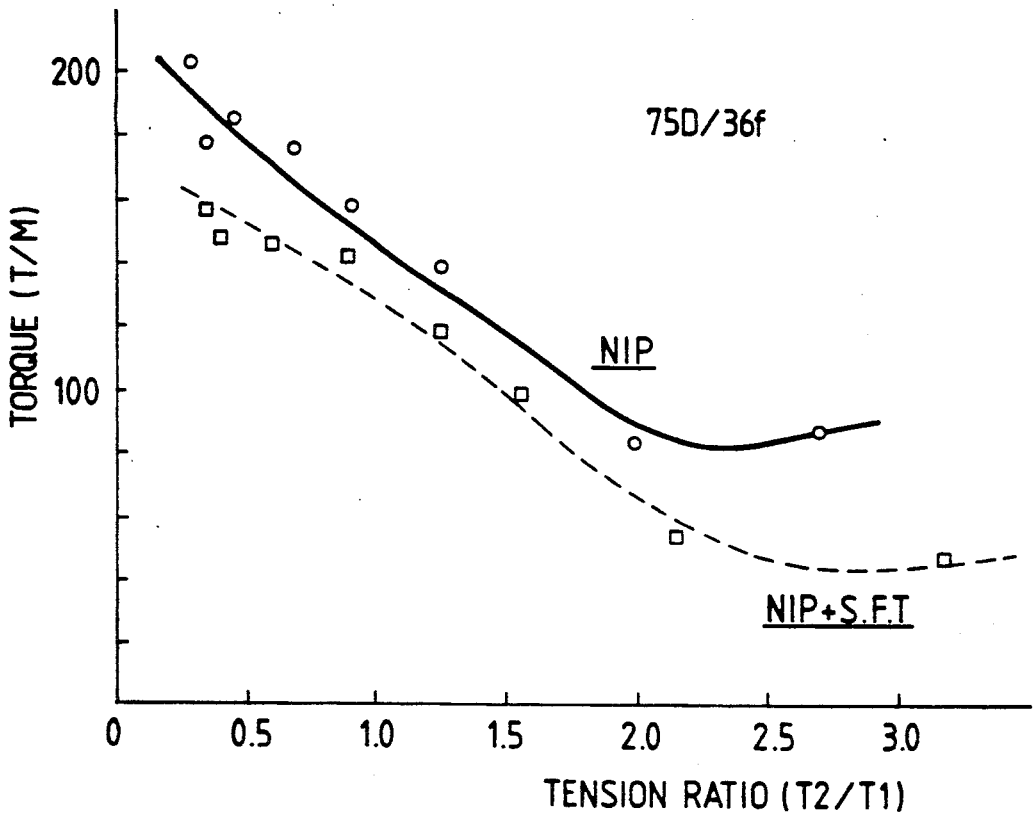
FIG. 14 is a graphic representation showing the relationship between the residual torque of a yarn and the tension ratio.
Figure 15:
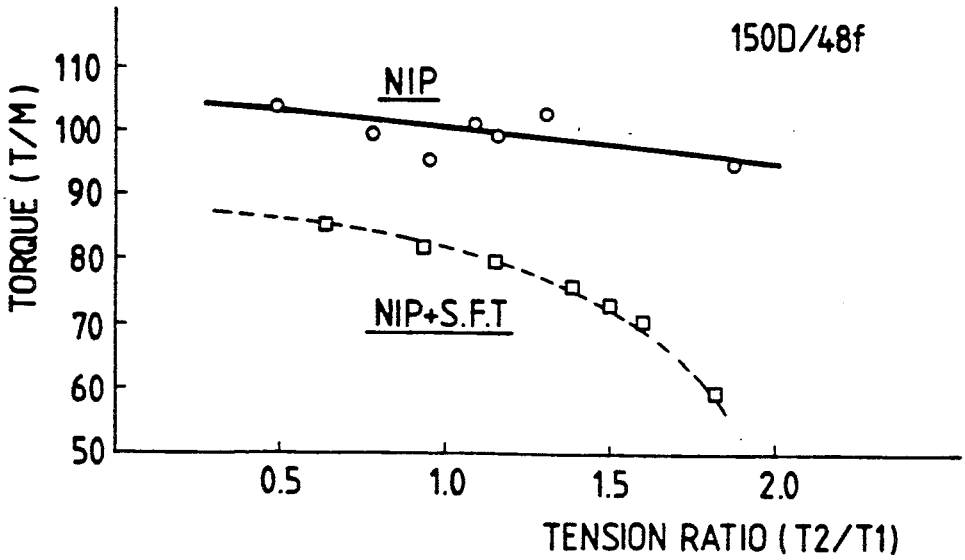
FIG. 15 is a graphic representation showing the relationship between the residual torque of a yarn and the tension ratio when a nip belt and a rotary cylinder are used.

With respect to the relationship between the tension ratio and the residual torque, the result of (i) case by the nip belt (NIP) and the result of (ii) case by the nip belt (NIP) and a winding member (self false twist, S.F.T.) are shown in FIG. 14 and FIG. 15, respectively. The residual torque is smaller in case of the belt + winding member than the case of merely having the belt, and in the finished woven fabrics and knitted products, less torsion or the like occurs.

EXPERIMENTAL EXAMPLE 4

The high speed texturing has been processed using the false twisting machine as shown in FIG. 9. The results are shown in Tables 1 and 2. In the machine conditions:

VR: rate of the belt running speed of the nip twister to the yarn speed

OF2: overfeed percentage (%) between feed rollers 3 and 19 in FIG. 9

OF3: overfeed percentage (%) between feed roller 19 and winding package in FIG. 9

$\theta$: angle of intersection of the belt of the nip twister

Hl: temperature of the first heater (20 in FIG. 9)

CP: contact pressure between the belts of the nip twister.

In case of only the nip twister, occurrence of fuzz increases as the yarn speed increases, but in case where the winding member (S.F.T.) is arranged downstream of the nip twister, fuzz was not produced irrespective of the yarn speed (Table 1). In case of 150D/48f, where the winding member is arranged, occurrence of fuzz appears but the number of occurrence is less than the case of only the nip twister.

TABLE 1

| | Number of Broken filaments (n/12000 m) | | |
|---|---|---|---|
| | Type | | |
| Yarn Speed | NIP TWISTER | NIP + S.F.T. | Draw Ratio |
| 700 | 0 | 0 | 1.672 |
| 800 | 8 | 0 | 1.725 |
| 850 | 15 | 0 | 1.760 |
| 900 | 22 | 0 | 1.760 |

Yarn: 75D/36f
Machine Condition:

VR: 1.449 OF2: 7.19%
$\theta$: 110° OF3: 4.53%

TABLE 1-continued

H1: 200° C. C.P: 220 (gr)

TABLE 2

| | Number of Broken filaments (n/12000 m) | | |
|---|---|---|---|
| | Type | | |
| Yarn Speed | NIP TWISTER | NIP + S.F.T. | Draw Ratio |
| 750 | 6 | 1 | 1.675 |
| 800 | 11 | 1 | 1.708 |
| 850 | 19 | 7 | 1.742 |
| 900 | 22 | 10 | 1.742 |

Yarn: 150D/48f
Machine Condition:

VR: 1.716 OF2: 2.46
$\theta$: 115° OF3: 5.21
H1: 210° C. C.P: 250 (gr)

What is claimed is:

1. A false twisting method for twisting a yarn which runs in a predetermined running direction under a predetermined tension, said method comprising the steps of:

winding said yarn about a circumference of a member positioned in the run of the yarn, wherein said yarn is wound about said member in a single circumferential direction from an initial point of contact with said member to a final point of contact with said member, wherein said member comprises a rotary member whose rotational shaft is obliquely arranged with respect to the running direction of the yarn, and overlapping a yarn portion downstream of the member and a yarn portion upstream of the member in a contacted state to provide a twist in the yarn, wherein the upstream and downstream yarn portions only overlap a single time, the downstream yarn portion runs substantially in the predetermined running direction at the final point of contact and the yarn portion upstream and the yarn portion downstream define a winding angle of substantially between approximately 135° and 315°.

2. The false twisting method according to claim 1, further comprising the step of changing the direction in which the yarn is wound about the member so as to switch a twisting direction of a yarn, whereby an S-twist is changed to a Z-twist and a Z-twist is changed to an S-twist.

3. The false twisting method according to claim 1, wherein said rotary member is cylindrical.

4. A false twisting method according to claim 1, wherein the upstream and downstream portions overlap without tying the yarn.

5. A false twisting apparatus for imparting a twist to a yarn which runs in a predetermined running direction under a predetermined tension, said apparatus comprising:

a rotary member having a rotational shaft which is obliquely arranged with respect to the running direction, a pair of upstream and downstream guide members arranged around the rotary member to define the funning direction of the yarn, the downstream guide member being positioned in substantially the range of approximately 135° to 315° in a winding direction of the yarn to the rotary member with respect to the upstream guide member, wherein the yarn is wound about an outer surface of the rotary member such that upstream and downstream yarn portions only overlap a single time, and means for winding said yarn about said rotary member in a single direction about the outer surface of said rotary member from an initial point of contact with said rotary member to a final point of contact with said rotary member such that the downstream yarn portion runs substantially in the predetermined running direction at the final point of contact.

6. The false twisting apparatus for yarns according to claim 5, wherein the rotational shaft of the rotary member is movable with respect to the running direction of the yarn.

7. The false twisting apparatus for yarns according to claim 6, wherein the rotational shaft of the rotary member intersects the running direction of the yarn at a predetermined angle of intersection, wherein the rotational shaft is movable with respect to the running direction of the yarn so as to enable adjustment of the angle of intersection of the rotational shaft with the running direction.

8. The false twisting apparatus for yarns according to claim 5, wherein at least one of the upstream and downstream guide members is movable relative to the rotational shaft of the rotary member.

9. The fast twisting apparatus for yarns according to claim 5, wherein the rotational shaft of the rotary member is driven.

10. The false twisting apparatus for yarns according to claim 5, wherein the outer surface of the rotary member is made of a slip resistant material.

11. The false twisting apparatus for yarns according to claim 10, wherein the outer surface of the rotary member includes a rubber lining.

12. The false twisting apparatus for yarns according to claim 5, wherein the shape of the rotary member is a circular cylinder, one end of which is provided with a collar to prevent yarn from slipping off the rotary member.

13. The false twisting apparatus for yarns according to claim 5, wherein the shape of the rotary member is a hand drum type in which a diameter of the rotary member varies from a maximum at opposite ends of the rotary member to a minimum at a central portion of the rotary member, wherein the yarn tends to be stabilized at the minimum diameter portion.

14. The false twisting apparatus for yarns according to claim 5, wherein the rotary member is provided with notches on the cylindrical surface thereof.

15. A false twisting apparatus according to claim 5, wherein the upstream and downstream portions overlap without tying the yarn.

16. A false twisting method for twisting a yarn which runs in a predetermined direction under a predetermined tension, said method comprising the steps of:

winding said yarn about a member positioned in the run of the yarn in a single direction about the outer surface of said member from an initial point of contact with said member to a final point of contact with said member and wherein the downstream yarn portion runs substantially in the predetermined running direction at the final point of contact, and overlapping a portion of the yarn downstream of the member and a portion of the yarn upstream of the member in a contacted state so as to form an X on a circumferential surface of the member to provide a twist in the yarn, wherein said step of overlapping is performed such that there is only one overlapping portion of yarn for every revolution of the yarn about the member.

17. A false twisting method for twisting a yarn which runs in a predetermined running direction under a predetermined tension, said method comprising the steps of:

changing a Z-twist in an upstream portion of said yarn to an S-twist, winding said yarn about a circumference of a member positioned in the run of the yarn, wherein said yarn is wound about said member in a single circumferential direction from an initial point of contact with said member to a final point of contact with said member and said member comprises a rotary member whose rotational shaft is obliquely arranged with respect to the running direction of the yarn, and overlapping a yarn portion downstream of the member and the yarn portion upstream of the member in a contacted state to substantially remove the S-twist in the yarn, wherein the upstream and downstream yarn portions only overlap a single time, wherein the downstream yarn portion runs substantially in the predetermined running direction at the final point of contact and the yarn portion upstream and the yarn portion downstream define a winding angle of substantially between approximately 135° and 315°.

18. The method of claim 17, wherein the step of changing a Z-twist to an S-twist is performed by a nip-type twister.

* * * * *